US008562378B2

(12) United States Patent
Su et al.

(10) Patent No.: US 8,562,378 B2
(45) Date of Patent: Oct. 22, 2013

(54) ELECTRICAL CONNECTOR ASSEMBLY WITH AN IMPROVED FRONT COVER

(75) Inventors: Ping-Sheng Su, New Taipei (TW); Jun Chen, Kunshan (CN); Feng-Jun Qi, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 37 days.

(21) Appl. No.: 13/231,991

(22) Filed: Sep. 14, 2011

(65) Prior Publication Data

US 2012/0064769 A1 Mar. 15, 2012

(30) Foreign Application Priority Data

Sep. 15, 2010 (CN) ..... 2010 2 0529968

(51) Int. Cl.
*H01R 9/03* (2006.01)

(52) U.S. Cl.
USPC ..... 439/607.55; 439/607.58

(58) Field of Classification Search
USPC ..... 439/607.55, 607.54, 607.56–607.58
See application file for complete search history.

(56) References Cited

U.S. PATENT DOCUMENTS 6,165,017 A * 12/2000 Kuo ..... 439/607.45
6,257,914 B1 * 7/2001 Comerci et al. ..... 439/357
6,595,801 B1 * 7/2003 Leonard et al. ..... 439/607.55
6,902,432 B2 * 6/2005 Morikawa et al. ..... 439/607.41
6,935,896 B1 * 8/2005 Tsai ..... 439/607.27
6,997,733 B2 * 2/2006 Peng ..... 439/353
7,175,465 B1 * 2/2007 Tsai ..... 439/352
7,252,548 B2 8/2007 Huang
7,481,664 B1 * 1/2009 Knoll et al. ..... 439/359
7,572,139 B2 * 8/2009 Montena ..... 439/358
7,628,638 B2 * 12/2009 Wu ..... 439/358
D614,305 S * 4/2010 Al-Ali et al. ..... D24/187
7,736,186 B2 * 6/2010 Li et al. ..... 439/607.55
7,845,965 B2 * 12/2010 Ko ..... 439/352
8,113,865 B1 * 2/2012 Yang et al. ..... 439/353
2005/0282424 A1 * 12/2005 Huang et al. ..... 439/353
2006/0141843 A1 * 6/2006 Huang et al. ..... 439/350
2006/0148300 A1 * 7/2006 Huang et al. ..... 439/353
2007/0141891 A1 * 6/2007 Koyama et al. ..... 439/358

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector assembly includes an insulative housing (1) with a trapezoid space (11), a contact module (2) assembled to the insulative housing, a shell (4) enclosing the insulative housing and a front cover (5) enclosing the shell. The shell has a top shell (41) and a bottom shell (42) assembled with each other, and the top shell comprises a base portion (411) and an extension portion (413) extending backwards from the base portion. The front cover includes a main portion (51) and a head portion (52) extending forwards from the main portion, and the head portion is enclosing the base portion, with the main portion enclosing the extension portion of the top shell and the bottom shell.

15 Claims, 5 Drawing Sheets

ELECTRICAL CONNECTOR ASSEMBLY WITH AN IMPROVED FRONT COVER

BACKGROUND OF THE INVENTION

1. Field of the Invention

The present invention generally relates to an electrical connector assembly, and more particularly to an electrical connector assembly used for high definition signal transmission.

2. Description of Related Art

Developed by Sony, Hitachi, Thomson (RCA), Philips, Matsushita (Panasonic), Toshiba and Silicon Image, the High-Definition Multimedia Interface (HDMI) has emerged as the connection standard for HDTV and the consumer electronics market. HDMI is the first digital interface to combine uncompressed high-definition video, multi-channel audio and intelligent format and command data in a single digital interface.

An electrical connector in accordance with HDMI standard comprises an insulative housing, a number of contacts received in the insulative housing, and a metallic shell shielding the insulative housing. U.S. Pat. No. 7,252,548B2 discloses an electrical connector compatible with HDMI transmitting protocol, and the electrical connector comprises an insulated housing, a plurality of contacts received in the insulated housing, a shielding member enclosing the insulated housing, and a top shell and a bottom shell enclosing an electrical conjunction between the contacts and a cable. After a rear segment of the shielding member coupled with front segments of the top and bottom shell, a combination between the insulated housing and the shielding member may be broken compressed by an extra force.

Correspondingly, it is desired to have an electrical connector assembly with improved shell to address the problems stated above.

BRIEF SUMMARY OF THE INVENTION

Accordingly, an object of the present invention is to provide an electrical connector assembly having an improved front cover prevent being broken.

In order to achieve the above-mentioned object, an electrical connector assembly in accordance with the present invention comprises an insulative housing with a trapezoid space, a contact module assembled to the insulative housing, a shell enclosing the insulative housing and a front cover enclosing the shell. The shell has a top shell and a bottom shell assembled with each other, and the top shell comprises a base portion and an extension portion extending backwards from the base portion. The front cover includes a main portion and a head portion extending forwards from the main portion, and the head portion is enclosing the base portion, with the main portion enclosing the extension portion of the top shell and the bottom shell.

Other objects, advantages and novel features of the invention will become more apparent from the following detailed description of the present embodiment when taken in conjunction with the accompanying drawings.

DETAILED DESCRIPTION OF THE INVENTION

Figure 1:
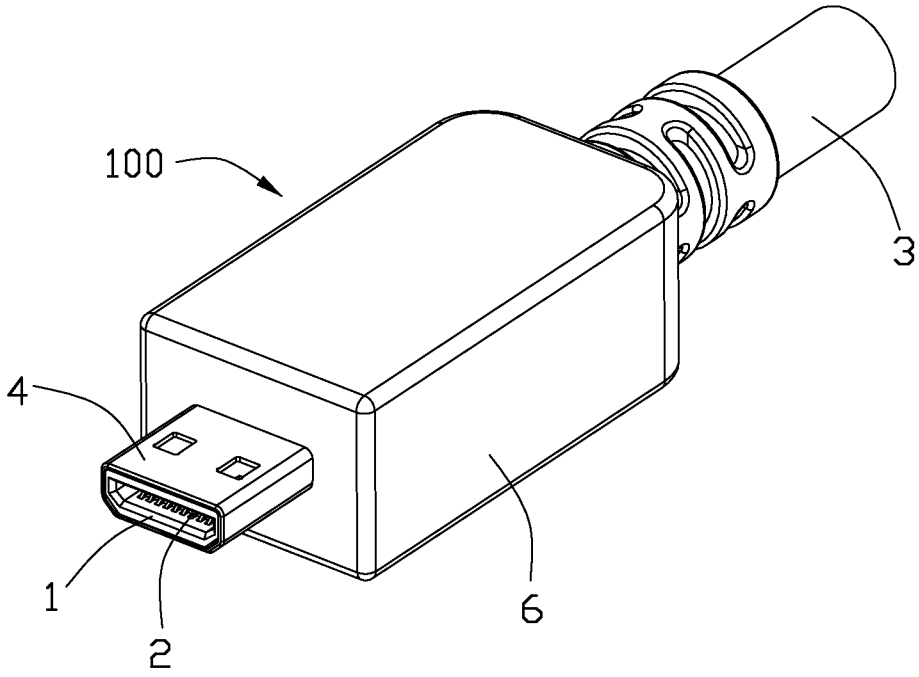
FIG. 1 is an assembled, perspective view of an electrical connector assembly of the present invention.

Reference will now be made to the drawing figures to describe the present invention in detail.

Figure 2:
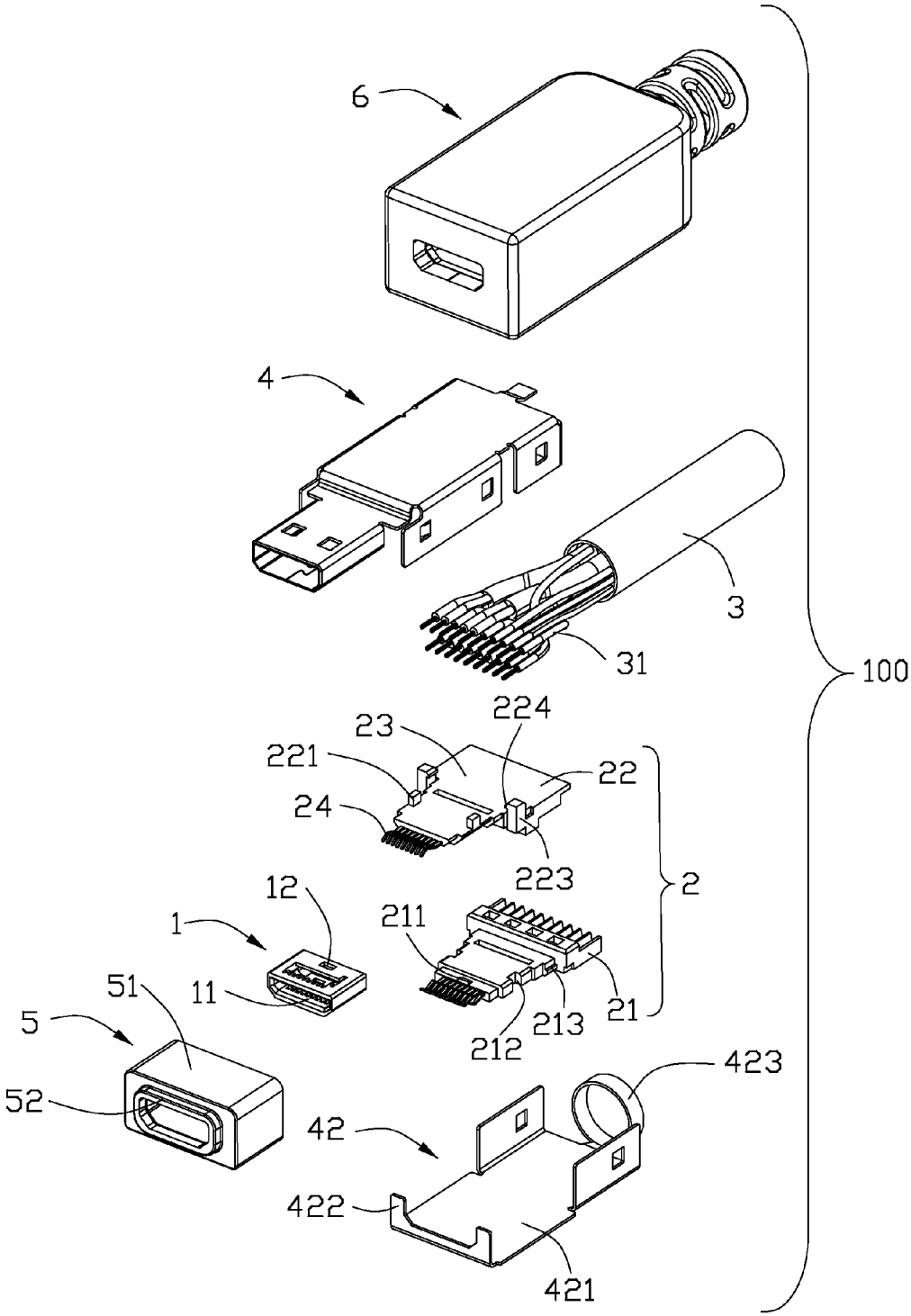
FIG. 2 is an exploded, perspective view of the electrical connector assembly shown in FIG. 1.
Figure 3:
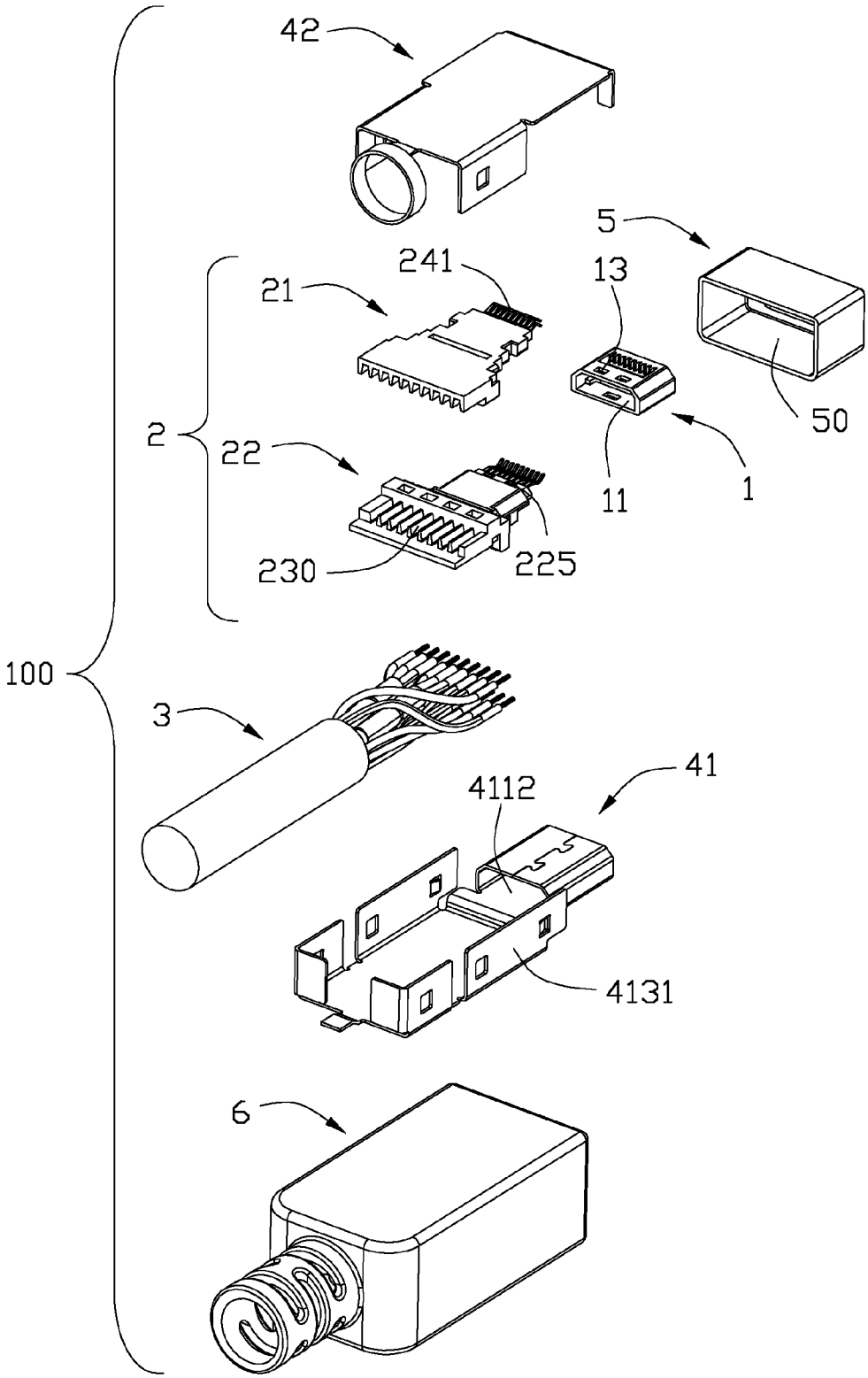
FIG. 3 is similar to FIG. 2, but viewed from another aspect.
Figure 4:
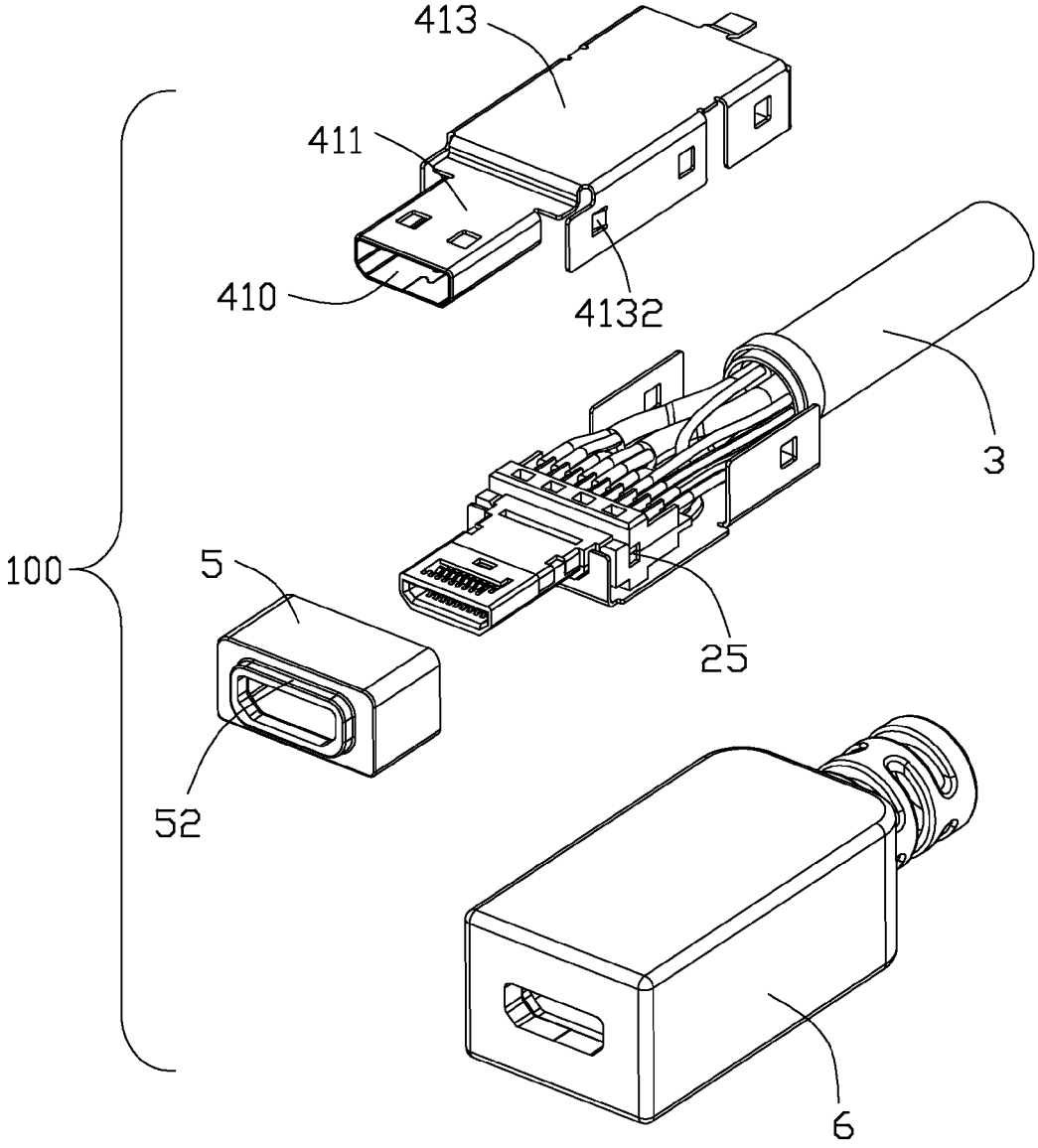
FIG. 4 is a partially assembled, perspective view of the electrical connector assembly shown in FIG. 2.
Figure 5:
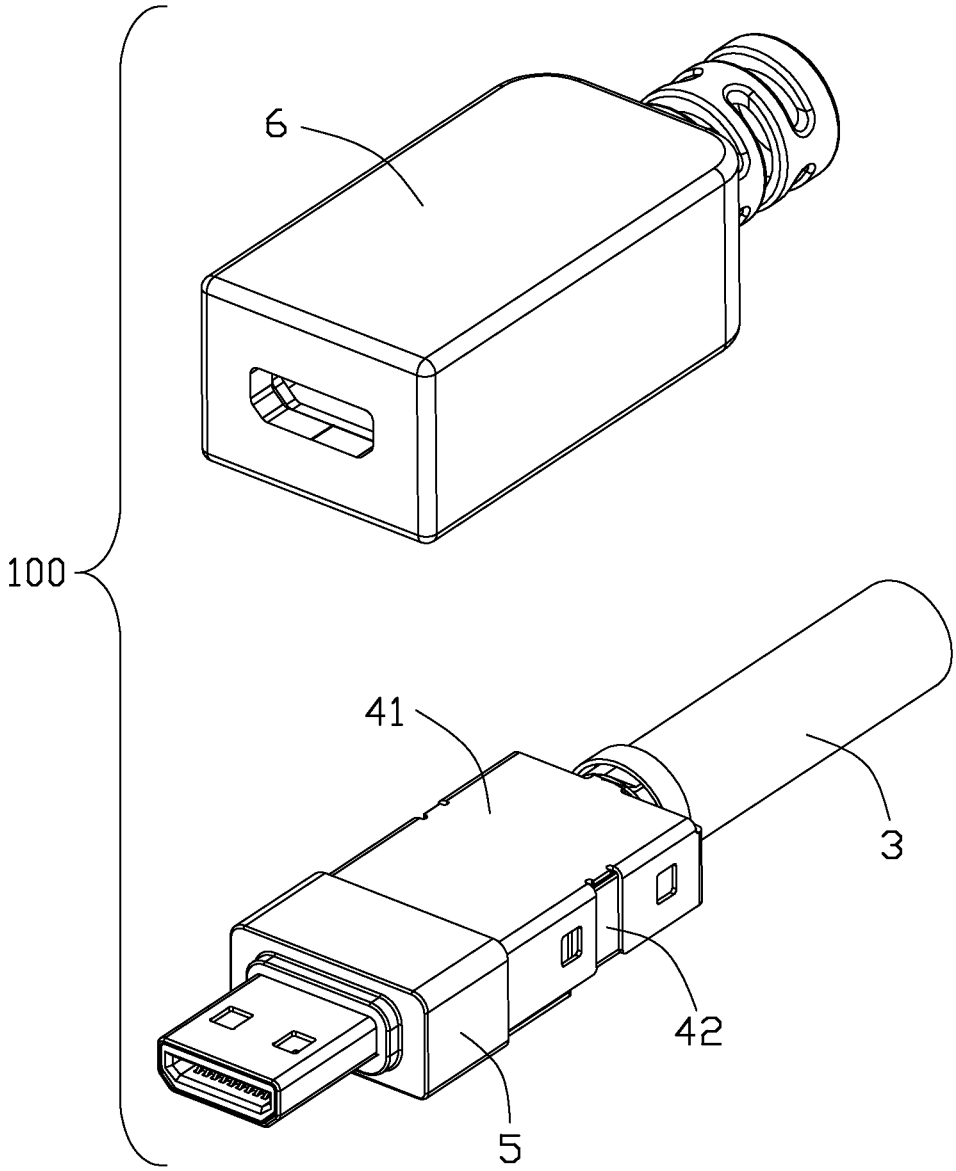
FIG. 5 is a further assembled, perspective view of the electrical connector assembly shown in FIG. 4.

Referring to FIGS. 1-3, an electrical connector assembly 100 in accordance with the present invention comprises an insulative housing 1, a contact module 2 received in the insulative housing 1, a cable 3 with a plurality of wires 31, a metallic shell 4 assembled to the insulative housing 1 and a front cover 5.

Referring to FIGS. 2-5, the insulative housing 1 comprises a trapezoid space 11 formed by four walls in the front for receiving a complementary connector (not shown). A first channel 12 is defined in a top wall of the insulative housing 1, and a pair of second channel 13 are defined in a bottom wall of the insulative housing 1.

The contact module 2 includes a first contact module 21 on an upper side and a second contact module 22 on a lower side, and the first contact module 21 is assembled to the second contact module 22 along an up-to-down direction. In the present embodiment, each contact module 2 comprises an insulator 23 and a plurality of contacts 24 insert-molded within the insulator 23. In alternative embodiments, each contact module 2 also can include a plurality of contacts 24 assembled to the insulative housing 1. Each contact 24 has an elastic contacting portion 241 on a front end and a tail portion on a rear end thereof, and the contacting portions 241 are exposed in the trapezoid space 11 to mate with terminals of complementary connector, the tail portions are received in grooves 230 arranged in the insulator 23 to connect with the wires 31 of the cable 3.

The first contact module 21 has a first locking tab 211 protruding upwards from a top surface thereof and a pair of cutouts 212 on both sides thereof. A pair of blocks 213 are extruding outwards on both sides of the first contact module 21, and each block 213 is located behind the corresponding cutout 212 on the same side. The second contact module 22 defines a pair of projecting portions 221 extending upwards on both sides, and the projecting portions 221 are received in the relative cutout 212 of the first contact module 21 to prevent the first contact module 21 moving relative to the second contact module 22 along a front-to-back direction. Additionally, the second contact module 22 defines a pair of coupling portions 223 on both side thereof, and a hook 224 is defined on a top end of each coupling portion 223. The hooks 224 are arranged face to face and behind the corresponding projecting portions 221. The second contact module 22 defines a pair of second locking tabs 225 extruding downwards from a lower surface thereof, and the second locking tabs 225 are neighboring to a front end of the second contact module 22.

The shell 4 is made of metallic material and comprises a top shell 41 and a bottom shell 42 assembled to each other along a direction perpendicular to a mating direction. The top shell 41 comprises a frame-shaped base portion 411 and a U-shaped extension portion 413 extending backwards from the base portion 411. The base portion 411 has a trapeziform cavity 410 and a top wall 4112. The top wall 4112 and an upper wall of the extension portion 413 are located on different level, and the upper wall of the extension portion 413 is higher than the top wall 4112. The extension portion 413 has a pair of lateral walls 4131 bent downwards, and a pair of obstructions 4132 are defined on each lateral wall 4131.

The bottom shell 42 comprises a bottom wall 421, a front flange 422 bent upwards from a front end of the bottom wall 421 and a clip portion 423 on a rear end thereof, and the clip portion 423 is of ring shape approximately.

The front cover 5 is made of metallic material, and comprises a rectangular main portion 51 and a head portion 52 extending forwards from the main portion 51. A roomage 50 is formed through the front cover 5 along the mating direction. The head portion 52 has an interior shape as same as an exterior shape of the base portion 411 of the top shell 41, and the head portion 52 has a tiny length along the mating direction.

In assembly, the first contact module 21 is assembled to the second contact module 22 along the up-to-down direction, and the projecting portions 221 of the second contact module 22 are inserted into the corresponding cutouts 212 of the first contact module 21, the hooks 224 of the second contact module 22 slide across the block 213 of the first contact module 21 and are latched with the corresponding block 213 to prevent the first contact module 21 moving relative to the second contact module 22 along the up-to-down direction. Then the first and second contact module 21, 22 are assembled to the insulative housing 1 along a rear-to-front direction, and a front segment of the contact module 2 is inserted into the trapezoid space 11 of the insulative housing 1, the contacting portions 241 of the contacts 24 are exposed in the trapezoid space 11. The first locking tab 211 on the first contact module 21 is engaging with the first channel 12 in the insulative housing 1, and the second locking tabs 225 of the second contact module 22 are accommodated in the corresponding second channel 13 of the insulative housing 1, therefore the contact module 2 is fastened with the insulative housing 1. The tail portions of the contacts 24 are soldered to the wires 31 of the cable 3.

Then the insulative housing 1 with the cable 3 is inserted into the top shell 41 along the rear-to-front direction, and the base portion 411 is shielding the insulative housing 1. A pair of notches 25 are formed on lateral sides after the first contact module 21 being assembled to the second contact module 22, and the obstructions 4132 of the top shell 41 are received in the corresponding notches 25 to prevent the contact module 2 moving along the mating direction relative to the top shell 41. Then the bottom shell 42 is assembled to the extension portion 413 of the top shell 41 along the up-to-down direction, and the cable 3 is extending through the clip portion 423 of the bottom shell 42.

The front cover 5 is enclosing the shell 4, and the head portion 52 is enclosing the base portion 411 of the top shell 41, the main portion 51 is enclosing a front section of the extension portion 413 and the bottom shell 42 to avoid a connecting area between the base portion 411 and the extension portion 413 being bent and broken.

After the cover 6 molded on the aforementioned components, the electrical connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insulative housing with a trapezoid space;

a contact module assembled to the insulative housing;

a shell enclosing the insulative housing, and having a top shell and a bottom shell assembled with each other, the top shell comprising a base portion and an extension portion extending backwards from the base portion; and a front cover enclosing a conjunction area between the base portion and the extension portion of the top shell; wherein the front cover includes a main portion and a head portion extending forwards from the main portion, and the head portion is enclosing the base portion, with the main portion enclosing the extension portion of the top shell and the bottom shell, the head portion is structured in a frame shape with a smaller dimension along a cross-section view, and the main portion has a bigger dimension along the cross-section view.

2. The electrical connector assembly as claimed in claim 1, wherein the front cover is made of metallic material, and the head portion has an interior shape as same as an exterior shape of the base portion of the top shell.

3. The electrical connector assembly as claimed in claim 2, wherein the contact module includes a first contact module and a second contact module under the first contact module, and each of the first and the second contact module comprises an insulator and a plurality of contacts insert-molded within the insulator.

4. The electrical connector assembly as claimed in claim 3, further comprising a cable with a plurality of wires, and wherein each contact has a tail portion on a rear end, each insulator has a plurality of grooves receiving the tail portions, and the tail portions are electrically connected with the wires.

5. The electrical connector assembly as claimed in claim 3, wherein a pair of notches are formed on lateral sides after the first contact module being assembled to the second contact module, and the shell defines a plurality of obstructions received in the corresponding notches.

6. The electrical connector assembly as claimed in claim 5, wherein the first contact module is assembled to the second contact module along an up-to-down direction, and the first contact module defines a pair of cutouts and a pair of blocks on both sides, the second contact module has a pair of coupling portion and a pair of projecting portions engaging with the corresponding cutouts.

7. The electrical connector assembly as claimed in claim 6, wherein a hook is defined on a top end of each coupling portion, and the hooks slide across the corresponding block and are latched with the block.

8. The electrical connector assembly as claimed in claim 1, wherein a roomage is formed through the front cover along a mating direction.

9. The electrical connector assembly as claimed in claim 8, wherein the base portion is of frame-shape, and the extension portion is of U-shape.

10. The electrical connector assembly as claimed in claim 1, wherein a front segment of the contact module is inserted into the space of the insulative housing along a rear-to-front direction.

11. The electrical connector assembly as claimed in claim 10, wherein the contact module has a locking tab protruding outwards, and the insulative housing has a channel receiving the locking tab.

12. The electrical connector assembly as claimed in claim 11, wherein the bottom shell comprises a bottom wall, a front flange bent upwards from a front end of the bottom wall and a clip portion on a rear end thereof, and the clip portion is of ring shape approximately.

13. An electrical connector assembly for use with a complementary connector, comprising:

an insulative housing being configured to be a mating port mateable with the complementary connector, and defining a plurality of passageways therein;

a pair of terminal modules back to back assembled to each other, each having an insulator having a front region assembled to a rear region of the housing, and a plurality of contacts integrally, each of said contacts defining a front deflectable contacting section extending into the housing and a rear cable connection section;

a cable having a plurality of wires respectively connected to the corresponding cable connection sections;

a metallic shell having a front section circumferentially enclosing the housing and a rear section circumferentially enclosing the terminal modules; and an insulative front cover defining a main portion and a head portion, the front cover enclosing a conjunction area between the front section and the rear section; wherein the head portion is dimensioned to snugly circumferentially enclose the front section of the shell while the main portion is dimensioned to snugly circumferentially enclose the rear section of the shell, and the head portion has a dimension smaller than that of the main portion along a cross-section view.

14. The electrical connector assembly as claimed in claim 13, wherein the shell shields the terminal modules in a front-to-back direction, and the front cover shields the shell in the front-to-back direction.

15. The electrical connector assembly as claimed in claim 14, further includes an insulative whole set cover circumferentially encloses the front cover and further shields the complete front cover in the front-to-back direction.

* * * * *